US009789356B2

(12) United States Patent
Dailey

(10) Patent No.: US 9,789,356 B2
(45) Date of Patent: Oct. 17, 2017

(54) EXERCISE MACHINE FOR USE WITH LOWER BODY NEGATIVE PRESSURE BOX

(71) Applicant: Christine M. Dailey, Alexandria, VA (US)

(72) Inventor: Christine M. Dailey, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 328 days.

(21) Appl. No.: 14/174,073

(22) Filed: Feb. 6, 2014

(65) Prior Publication Data

US 2014/0235411 A1 Aug. 21, 2014

Related U.S. Application Data

(60) Provisional application No. 61/767,551, filed on Feb. 21, 2013.

(51) Int. Cl.

| | |
|---|---|
| ***A63B 22/06*** | (2006.01) |
| ***A63B 21/02*** | (2006.01) |
| ***A63B 22/00*** | (2006.01) |
| ***A63B 23/035*** | (2006.01) |

(Continued)

(52) U.S. Cl.

CPC ..... *A63B 22/0605* (2013.01); *A63B 21/023* (2013.01); *A63B 22/0056* (2013.01); *A63B 23/03541* (2013.01); *A63B 23/0429* (2013.01); *A63B 21/0083* (2013.01); *A63B 21/0421* (2013.01); *A63B 2022/0038* (2013.01);

(Continued)

(58) Field of Classification Search

CPC ..... A63B 21/023; A63B 21/0421; A63B 21/0083; A63B 22/0056; A63B 22/06; A63B 22/0605; A63B 22/0652; A63B 23/0429; A63B 2022/0038; A63B 2022/0033; A63B 2022/0652; A63B 2023/0441; A63B 2208/0247;

(Continued)

(56) References Cited

U.S. PATENT DOCUMENTS 4,722,520 A * 2/1988 Lee ..... 482/73
4,883,270 A * 11/1989 Maag ..... 482/97

(Continued)

*Primary Examiner* — Andrew S Lo
*Assistant Examiner* — Gregory Winter
(74) *Attorney, Agent, or Firm* — US Naval Research Laboratory; Richard F. Bis

(57) ABSTRACT

A compact, portable, lightweight, easily transportable leg press exercise apparatus to simulate both exercise and the daily activity of sitting in a microgravity environment. The exercise portion of the apparatus creates stress on the lower extremities by supplying a variable resistance to a reciprocating foot pedal by way of a coil spring and damper system acting through a four-bar linkage. The chair is adjustable in angle to fit each user and to simulate a force that is two-thirds of body weight. By combining resistance exercise and lower body negative pressure with the LBNP leg press exercise apparatus, the users experience one or more times body weight (BW) in stress on their musculoskeletal, cardiovascular and nervous systems. By achieving one times BW or greater (artificial gravity) during exercise and two-thirds BW during sitting, the gap between the precondition and post condition syndrome will become smaller.

12 Claims, 21 Drawing Sheets

(51) Int. Cl.
*A63B 23/04* (2006.01)
*A63B 21/008* (2006.01)
*A63B 21/04* (2006.01)

(52) U.S. Cl.
CPC ..... *A63B 2023/0441* (2013.01); *A63B 2208/0247* (2013.01); *A63B 2208/056* (2013.01); *A63B 2210/00* (2013.01); *A63B 2225/09* (2013.01); *A63B 2230/045* (2013.01)

(58) Field of Classification Search
CPC ..... A63B 2208/056; A63B 2225/09; A63B 2230/045; A63B 2230/062; A63B 2230/067
USPC ... 482/51, 57–59, 63, 92, 93, 100, 110–112, 482/121–123, 128–130, 133, 135–138, 482/142
See application file for complete search history.

(56) References Cited

U.S. PATENT DOCUMENTS

| | | | | |
|---|---|---|---|---|
| 5,067,710 | A * | 11/1991 | Watterson et al. | 482/3 |
| 5,106,081 | A * | 4/1992 | Webb | 482/137 |
| 5,366,432 | A * | 11/1994 | Habing et al. | 482/138 |
| 6,394,938 | B1 * | 5/2002 | Tornabene | 482/142 |
| 6,475,127 | B1 * | 11/2002 | Koenig | 482/142 |
| 6,500,099 | B1 * | 12/2002 | Eschenbach | 482/57 |
| 7,115,081 | B2 * | 10/2006 | Stearns | A63B 21/055 482/140 |
| 8,425,384 | B2 * | 4/2013 | Garner | 482/92 |
| 2004/0038786 | A1 * | 2/2004 | Kuo et al. | 482/130 |
| 2011/0245043 | A1 * | 10/2011 | Mitchell | 482/62 |
| 2011/0294633 | A1 * | 12/2011 | Esrick | A63B 21/00069 482/139 |

* cited by examiner

EXERCISE MACHINE FOR USE WITH LOWER BODY NEGATIVE PRESSURE BOX

CROSS-REFERENCE TO RELATED APPLICATIONS

This Application claims the benefit of U.S. Provisional Application 61/767,551 filed on Feb. 21, 2013, and incorporated herein by reference, and is related to U.S. application Ser. No. 14/174,090, filed concurrently herewith.

FIELD OF THE INVENTION

The invention is directed to a physical conditioning system for space travel and terrestrial rehabilitation protocols, and more particularly, to an exercise machine that can operate in a microgravity environment with a Lower Body Negative Pressure Box or as an apparatus for rehabilitation purposes.

BACKGROUND OF THE INVENTION

Gravity has had a profound effect on the development of life on Earth over millions of years and has shaped the anatomy and physiology of human beings. Exposure to microgravity has been shown to affect the body causing it to undergo a reduction in heart size and blood volume, impaired balance control, changes in nervous system sensitivity, decreases in bone and muscle mass, and reduction of the immune function. Astronauts in space during short or long-term missions have demonstrated these physiological changes, known as space deconditioning, which may lead to undesirable health consequences and to operational difficulties, especially during emergency situations. Physiological deconditioning is a critical problem in space, especially during long-term missions. Despite physiological deconditioning, a future involving microgravity environments is quickly becoming a reality.

With the recent advent of space tourism and with longer space missions planned, greater numbers of astronauts will work and live in low-gravity environments, and the need to understand the in-flight and post-flight consequences of this lack of gravity will become more significant. The physiological adaptations have proven to be less problematic while still in space, but become more pronounced after an astronaut returns to Earth. Many different types of countermeasures have been developed over the years, ranging from specific diets to heavy exercise protocols that must be performed daily by the astronauts during a space mission. Ideally, the best way to counteract the consequences of space deconditioning would be the use of artificial gravity through centrifugation or other biomechanical stressors for periods of time during microgravity exposure.

Among the countermeasures currently under testing, daily exercise in space seems to be the most complete, since it can have an important positive impact on bone demineralization, muscle loss and cardiovascular deconditioning. The mechanical unloading affects the musculoskeletal system even in short-duration space flights. It has been reported that after only two weeks in space, muscle mass can decrease by 20%. For missions of three to six months duration this loss of muscle mass can rise to 30%, especially affecting postural muscles. The decrease in bone mass is also of great concern to space physiologists and physicians, as the normal processes of bone formation and resorption are disturbed, favoring a loss of bone tissue. This process begins almost immediately upon introduction into microgravity, and can range between one and two percent of bone mass loss per month. One of the first responses to space flight is the shift of blood and body fluids towards the upper body, with subsequent adaptations occurring over a few days to lower overall blood volume through activation of several mechanisms. It is upon return to Earth that the cardiovascular deconditioning raises concerns by producing significant orthostatic intolerance and decreasing aerobic performance.

Astronauts participating in space shuttle missions, which are usually two weeks long, exercise for approximately 30 minutes per day. Astronauts who live on the International Space Station (ISS) for much longer periods of time are required to exercise for approximately two hours per day. Each astronaut's exercise routine is monitored, and can be adjusted if necessary based on his or her monthly fitness assessment. If astronauts are scheduled to perform a spacewalk, their exercise routines may be altered or restricted.

Understanding how to combat the negative effects imposed by microgravity could allow researchers to apply an exercise routine to terrestrial rehabilitation protocols that would decrease the required rehabilitation time. The negative effects discussed above occur at an accelerated rate in space in comparison to on Earth, allowing researchers to collect data faster.

One in six Americans has osteoporosis or early signs of the disease. Even though the causes behind osteoporosis and space induced bone loss are different, the treatments may be similar.

The human body experiences similar physiological changes as astronauts after encountering shattered bones. When a bone is broken or fractured the healing process is very slow or incomplete because the blood supply is often damaged. This may lead to amputation and/or a longer recovery time. When the cast is removed, the weakness resulting from muscle atrophy is very apparent. The rate of major amputations has changed throughout the course of combat operations in the Afghanistan Theater of Operations (ATO). This rate of amputation suggests an increasing demand on the healthcare continuum, from the battlefield to long-term rehabilitation centers. Again, the reasons these negative effects occur are different but the solution can very much be the same. Daily exercise using range-of-motion and muscle-strengthening exercises is necessary for people to combat stiffness and regain strength. Applying a differential pressure not only adds stress to the body's systems; it forces the blood to flow in its most healthy and natural way.

The effectiveness of exercise protocols and equipment for astronauts in space are unresolved and still under discussion. Prior studies indicate that all exercise in space to date has lacked sufficient mechanical and physiological loads to maintain preflight musculoskeletal mass, strength, and aerobic capacity. Researchers have been pairing exercise with a Lower Body Negative Pressure (LBNP) Box. The LBNP Box is a sealed device into which the user is partially inserted. A seal near the waist allows a vacuum to be applied to the device, thus creating a lower relative pressure on the user's lower body. This lower pressure helps pull bodily fluids toward the feet. Exercise within an artificial environment (LBNP Box) has been shown to counteract microgravity-induced deconditioning during terrestrial testing. A recent study on the addition of a treadmill to an LBNP Box has demonstrated that it is able to simulate the physiological and biomechanical features of upright exercise. However, the treadmill's mechanical design lacks mobility and is both large and heavy, making it unsuitable for space flight.

An exemplary LBNP Box is described in T. Russomano et al., "Development of a lower body negative pressure box with an environmental control system for physiological studies", *Advances in Space Research* 38, 6; 1233-1239 (2005).

BRIEF SUMMARY OF THE INVENTION

Resistance exercise coupled with lower body negative pressure (LBNP) has been shown to be effective in counteracting some of the deconditioning related problems. The development of a compact, lightweight, and effective resistance exercise machine that works within a LBNP Box has, however, proven to be difficult.

In one embodiment, the resistance exercise machine for a lower body negative pressure (LBNP) Box prevents microgravity-induced deconditioning by simulating physiological and biomechanical features of upright exercise and daily activities. This combination can determine whether the kinematics, musculoskeletal loadings, and metabolic rate during supine exercise within the LBNP Box are similar to those of an upright posture in Earth gravity (1G).

The compact, easily transportable, exercise machine, named Entirety™, simulates both exercise and the daily activity of sitting. The exercise portion of the apparatus creates stress on the lower extremities by supplying a variable resistance to a reciprocating foot pedal. This resistance is created from a coil spring and damper system acting through a four-bar linkage. The resisting force increases as a function of leg extension to maximize work done by the user in each cycle of motion. The sitting portion of the exercise apparatus creates a resistance applied to the posterior side of the lower extremities by the use of an adjustable chair. The angle of the chair can be adjusted to fit each user and to simulate a force that is about two-thirds (⅔) of body weight. Humans sit between six to eight hours a day, which means that the posterior side is accustomed to these forces.

The exercise apparatus can be paired with an existing LBNP Box to add an evenly distributed pressure-induced stress to the lower extremities. By combining resistance exercise and lower body negative pressure, the users will experience one or more times body weight (BW) in stress on their musculoskeletal, cardiovascular, and nervous systems. By achieving one times BW or greater (i.e., artificial gravity) during exercise and ⅔ BW during sitting, the gap between the precondition (before space flight) and post condition (after space flight) syndrome will become smaller.

In one embodiment, a leg press exercise apparatus is provided for use with a Lower Body Negative Pressure Box. The leg press exercise apparatus includes a rectangular base frame and an adjustable sliding frame member is attached to the rectangular frame for adjusting a position of the sliding frame member along the rectangular frame to accommodate users of different heights. The leg press exercise apparatus includes a linkage assembly having four bars, with each pair of bars mounted at a pivot point on a lower end on opposite sides of the rectangular frame, and mounted at an upper end to the support bracket. The leg press exercise apparatus further includes a pair of adjustable foot pedals with each foot pedal mounted to a corresponding support bracket to which a pair of bars of the linkage assembly is mounted. A coil spring and damper mechanism is attached at a first end to an adjustable ground pivot, the coil spring and damper mechanism providing resistance during a user's cyclic movement of the foot pedals through compression of the coil spring. A spring-loaded pin detent mechanism adjusts the position of the sliding frame member for each user. A two member chair is preferably included in the exercise device and is adjustable in both angle and linear distance to apply a resistance force to a posterior side of the user's lower extremities during use of the leg press exercise apparatus.

The leg press exercise apparatus could be used to collect and establish a database under both terrestrial conditions and microgravity environments, such as the International Space Station (ISS) to enhance the understanding of medical researchers of how LBNP paired with resistance exercise impacts osteoporosis, orthostatic intolerance and cardiovascular health. The technology used in the leg press exercise machine could also be used to enhance rehabilitation protocols.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

DETAILED DESCRIPTION OF THE INVENTION

The following detailed description is provided as an enabling teaching of embodiments of the invention. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

Figure 1A:
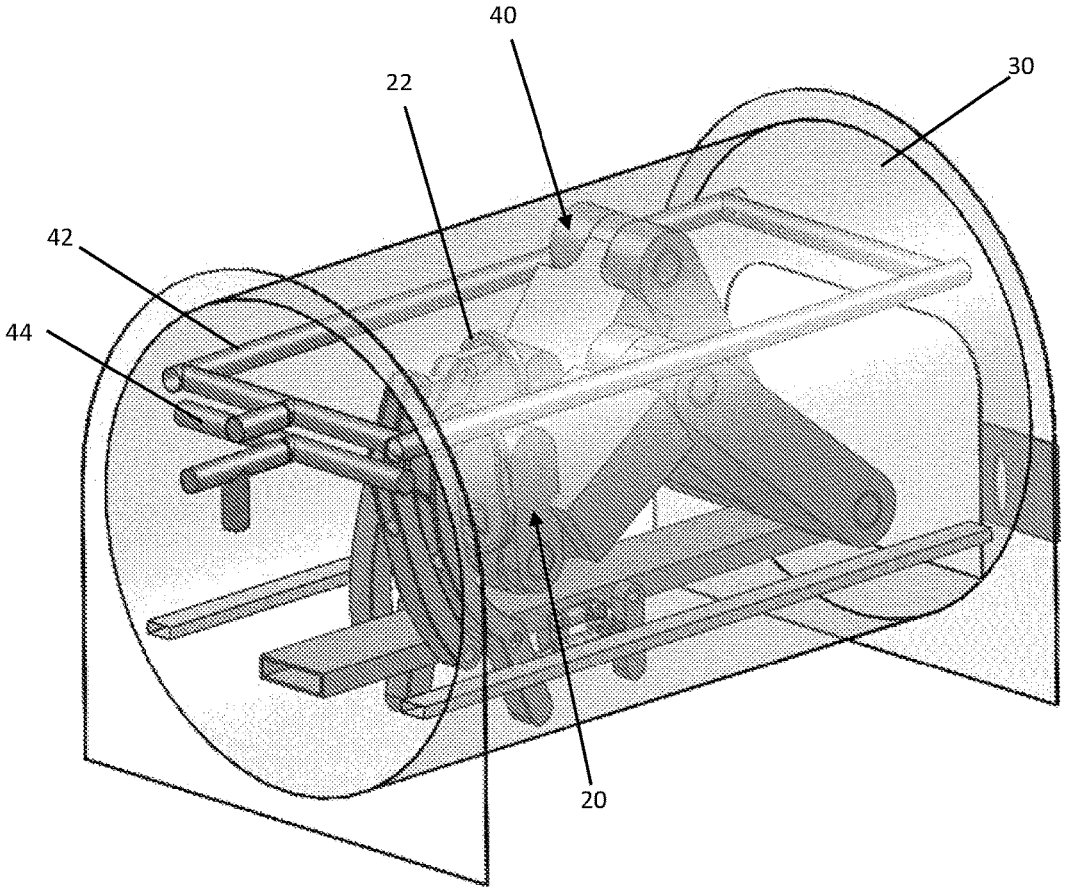
FIG. 1A illustrates a leg press exercise apparatus paired with an existing environmentally controlled LBNP Box in an exemplary embodiment.
Figure 1B:
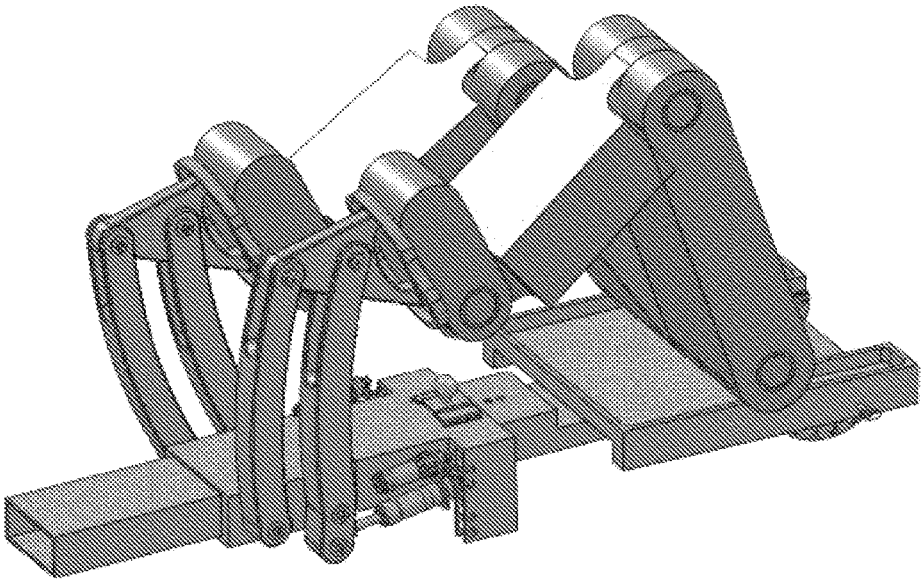
FIG. 1B illustrates a perspective view of the leg press exercise apparatus including leg simulation links.
Figure 1C:
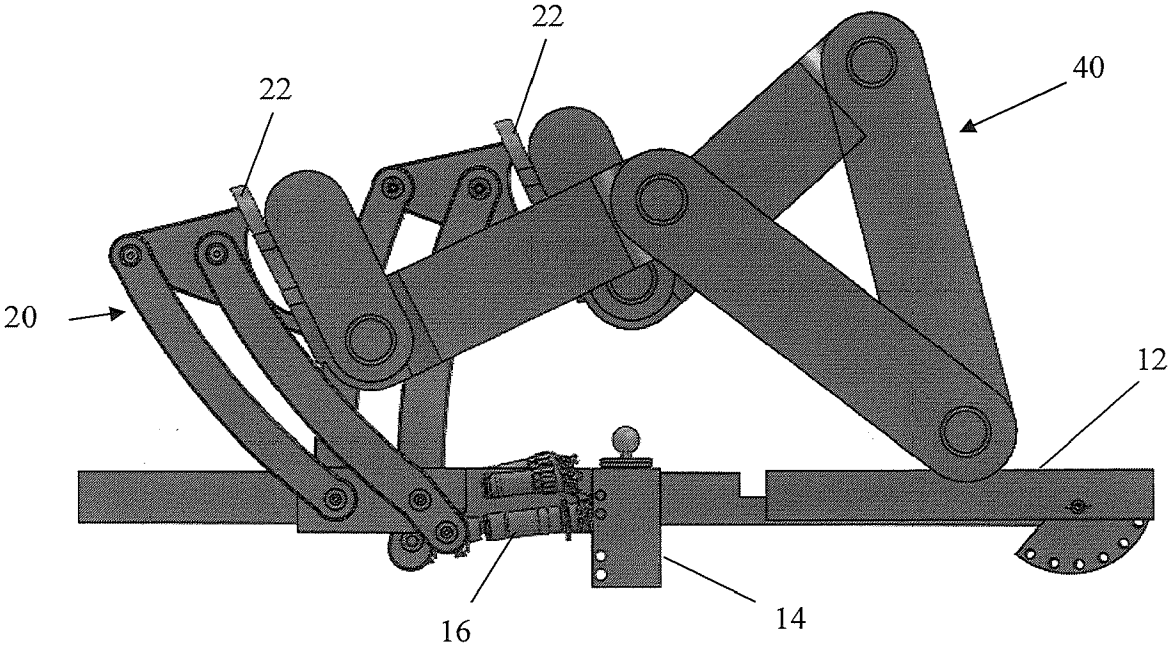
FIG. 1C illustrates a side elevation view of the leg press exercise apparatus including leg simulation links.

In an exemplary embodiment, the leg press exercise apparatus serves as a portable, lightweight, and effective exercise system that can be paired with an existing environmentally controlled LBNP Box 30 to form a LBNP leg press exercise apparatus as shown in FIG. 1A. In this illustration, the legs of the user are simulated by links 40. Tubes 42, 44 represent cooling ducts. Four-bar linkage 20 movement is controlled by foot pedals 22. The LBNP leg press exercise apparatus stresses the user's lower extremities to counteract the effects of microgravity induced syndrome. FIGS. 1B and 1C illustrate perspective and side elevation views, respectively, of the leg press exercise apparatus including the leg simulation links 40 with the leg press exercise apparatus positioned outside the LBNP Box.

Figure 2A:
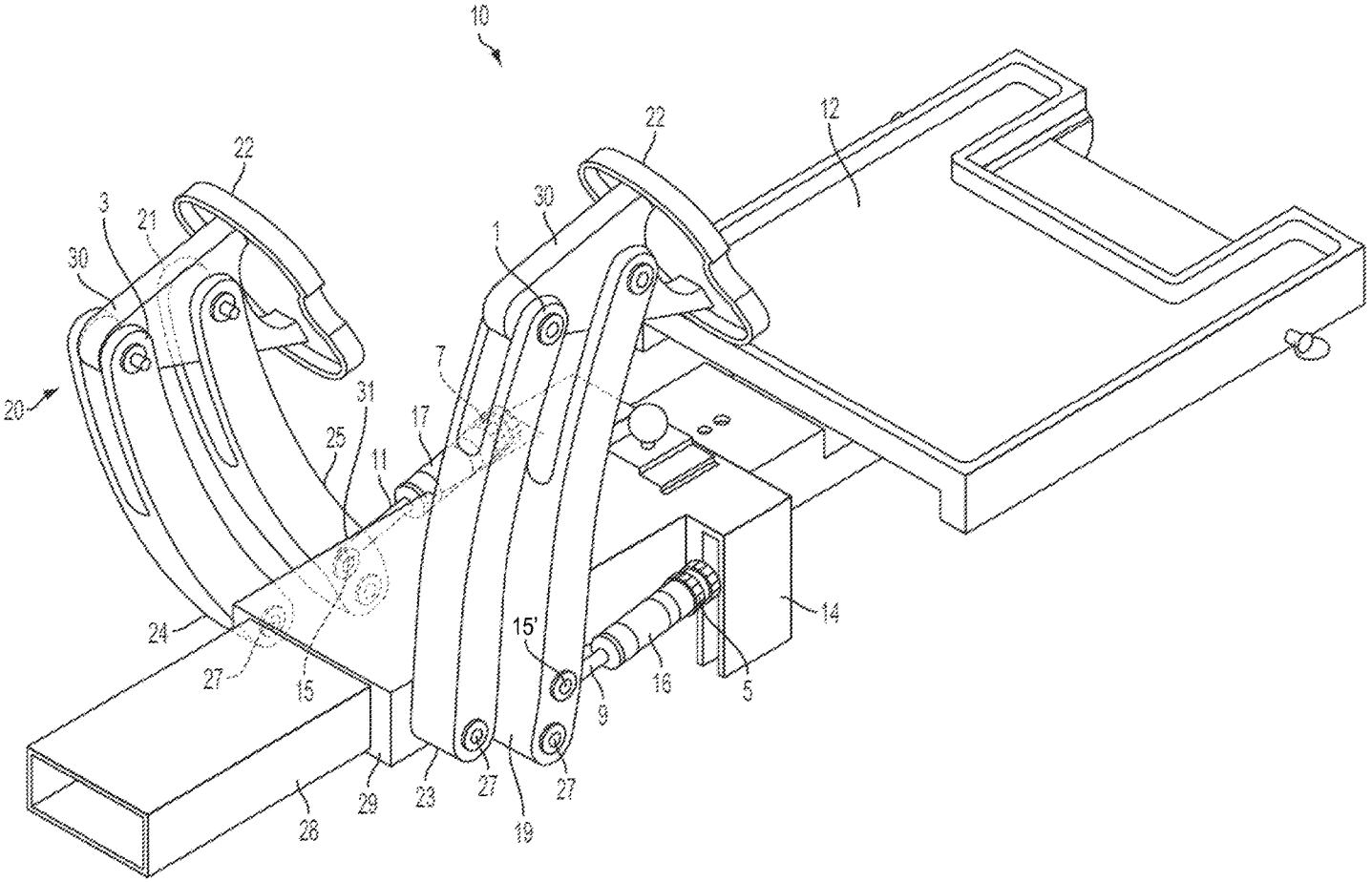
FIGS. 2A-2B illustrate perspective views of an exemplary embodiment of the leg press exercise apparatus with the four-bar linkage at different positions during a cycle of movement.
Figure 2B:
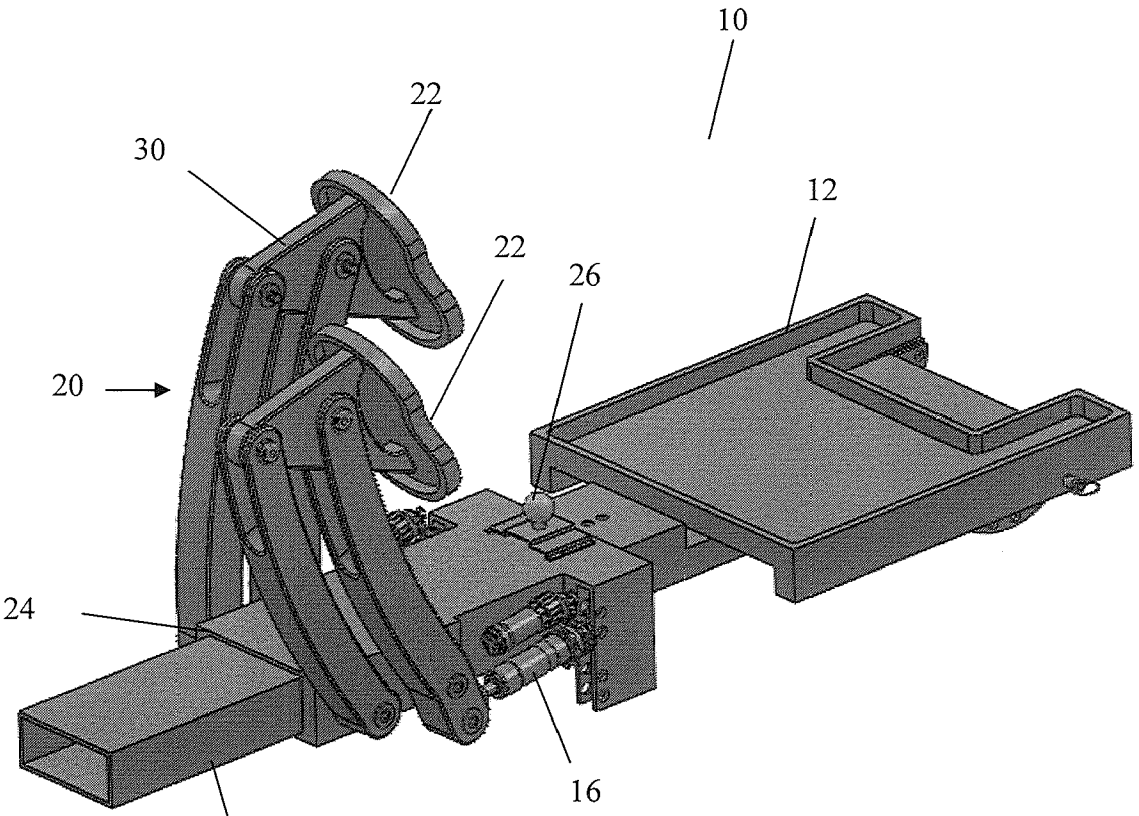
Figure 16:
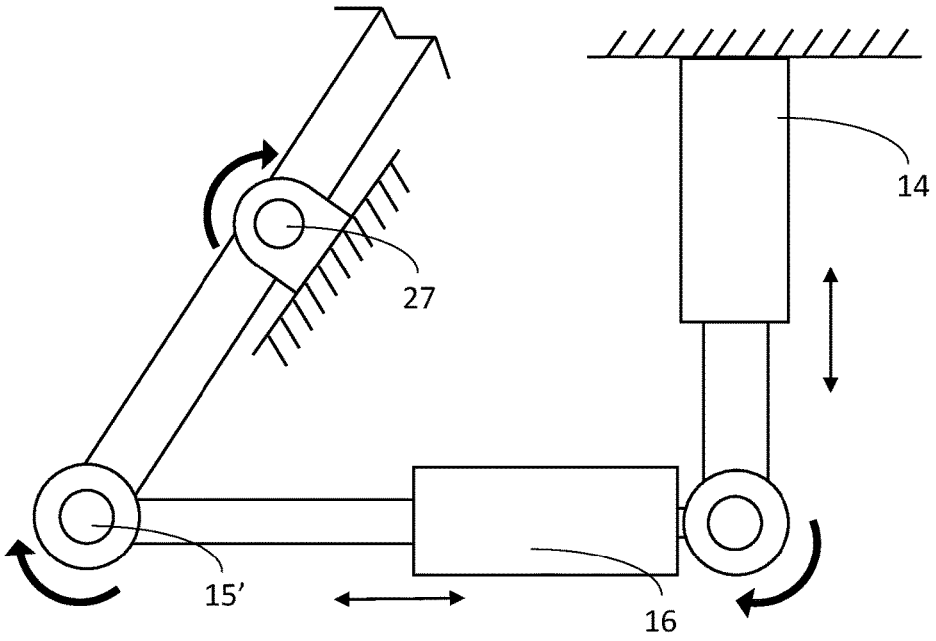
FIG. 16 illustrates a schematic diagram of the slider-crank mechanism including a linear actuator for adjusting the position of the ground pivot.
Figure 17:
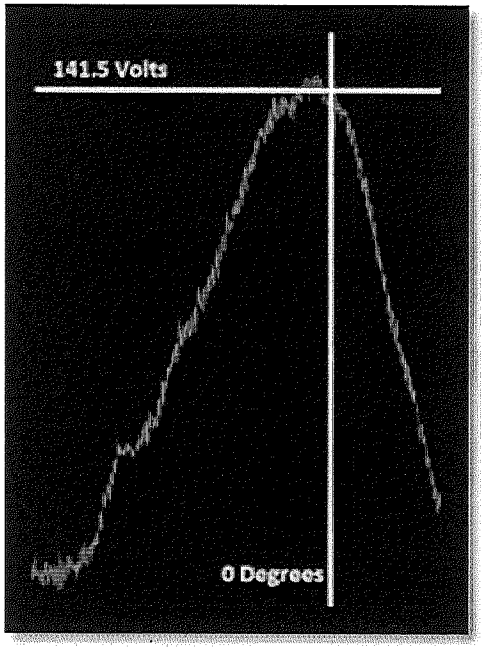
Figure 18:
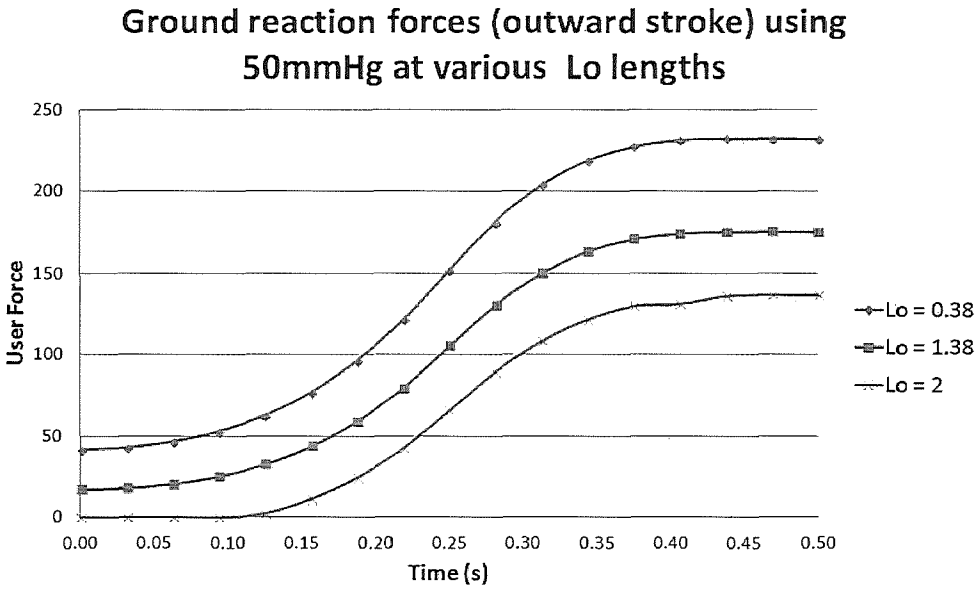
Figure 19:
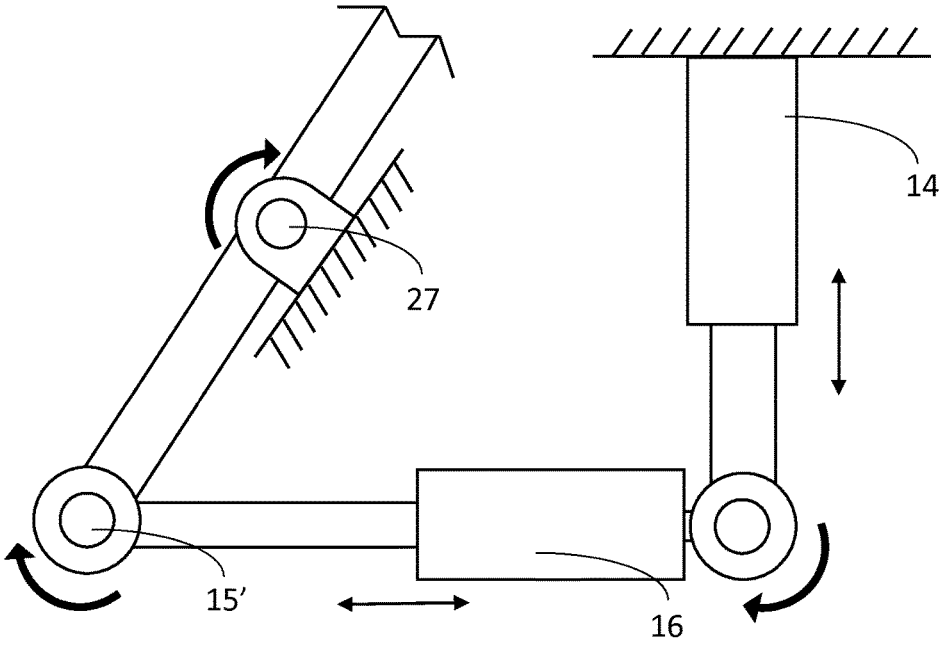

FIGS. 2A-2B illustrate perspective views of an embodiment of the leg press exercise apparatus 10 with the four-bar linkage 20 at different positions during a cycle of movement. The leg press exercise apparatus 10 includes a four-bar linkage 20, with a first pair of spaced-apart bars 19 and a second pair of spaced-apart bars 21, rectangular frame 28, foot pedals with strain gages 22, a coil spring and damper mechanism 16 and 17 for each respective pair of spaced apart bars 19 and 21, and an adjustable seat or chair 12. Each pair of bars 19 and 21 in the four-bar linkage 20 is pivotally attached at respective ends 23 and 25 at corresponding pivot points 27 on opposite sides 29 and 31 of adjustable sliding frame member 24. Each coil spring and damper mechanism 16 and 17 (with the latter shown in phantom in FIG. 2A) is respectively attached at one end 9 and 11 to bars 19 and 21 by ground pivots 15 and 15', and at each respective second end 5 and 7 to the corresponding side 29 and 31 of adjustable sliding frame member 24. An upper end 1 and 3 of each respective pair of bars is attached to a support bracket 30 on which a foot pedal 22 is mounted. The sliding frame member 24 is mounted on the rectangular base frame 28 with its position adjustable relative to the rectangular frame 28 by a knob and pin detent mechanism 26. In some embodiments, a linear actuator can be included in the leg press exercise apparatus 10 as described below. The location of the linear actuator is indicated by reference number 14 in FIG. 2A (not illustrated) and is illustrated schematically in FIG. 16.

Four-Bar Linkage in Conjunction with Coil Spring and Damper System

1. Kinematics

Figure 3:
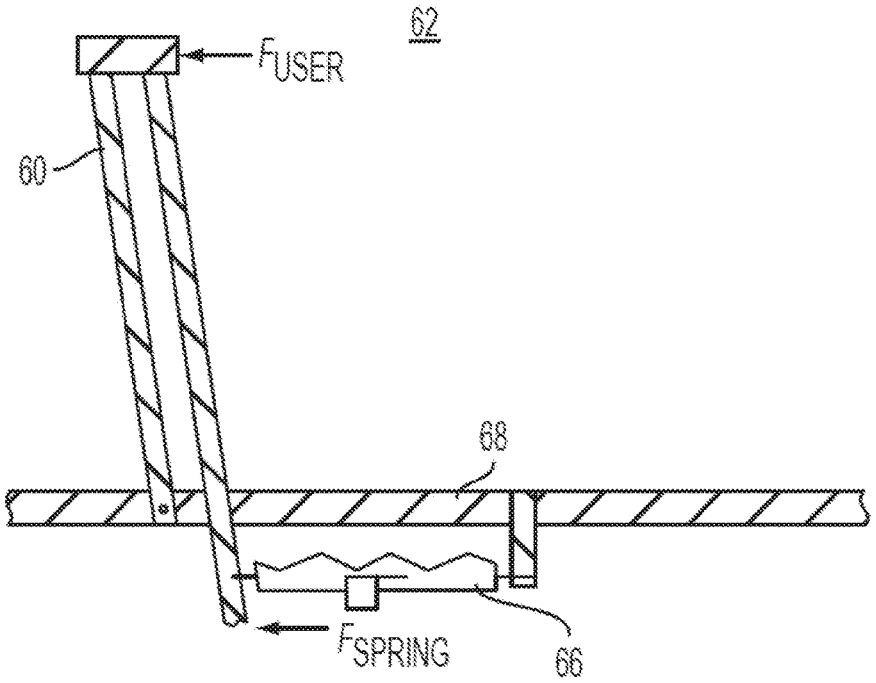
FIG. 3 illustrates a two dimensional (2-D) diagram of a four-bar mechanism paired with a sliding crank mechanism.

FIG. 3 illustrates a two dimensional diagram of a four-bar parallelogram linkage 60 paired with a sliding crank mechanism 66 representing kinematics of the four-bar linkage and coil spring and damper mechanisms. The sliding crank 66 is a spring and damping system that provides a variable resistance. As shown in FIG. 3, if a force ($F_{user}$) 62 is applied by the user to the foot pedal, the parallelogram linkage 60 will guide the foot pedal along a circular-arc path at a fixed angle relative to the frame 68. This maintains a generally perpendicular relationship between the lower leg and the foot. Applying forces in this manner to the musculoskeletal system is believed to be one of the most efficient ways to counteract osteoporosis according to the National Osteoporosis Foundation.

With further reference to FIGS. 2A-2B, in order to accommodate a wide range of potential users, the location of the pedal system 22 is adjustable relative to the seat 12 location. This is accomplished through the use of a sliding member 24 that allows the user to adjust the position of the device 10 along the rectangular base frame 28.

Figure 4:
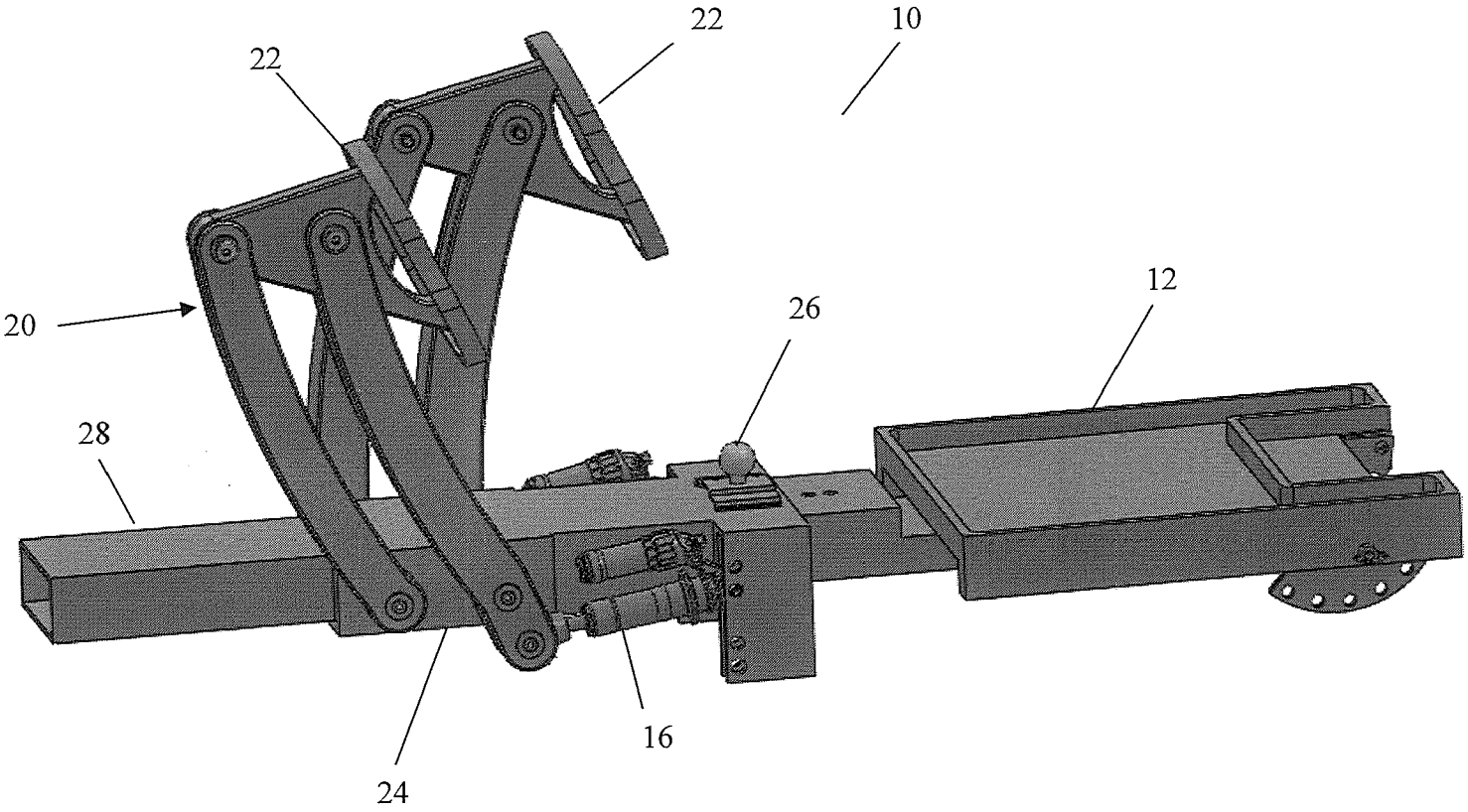
FIG. 4 illustrates a perspective view of the leg press exercise apparatus including a spring-loaded knob and pin detent mechanism which allows the user to adjust the sliding member over a range of positions in an exemplary embodiment.
Figure 5:
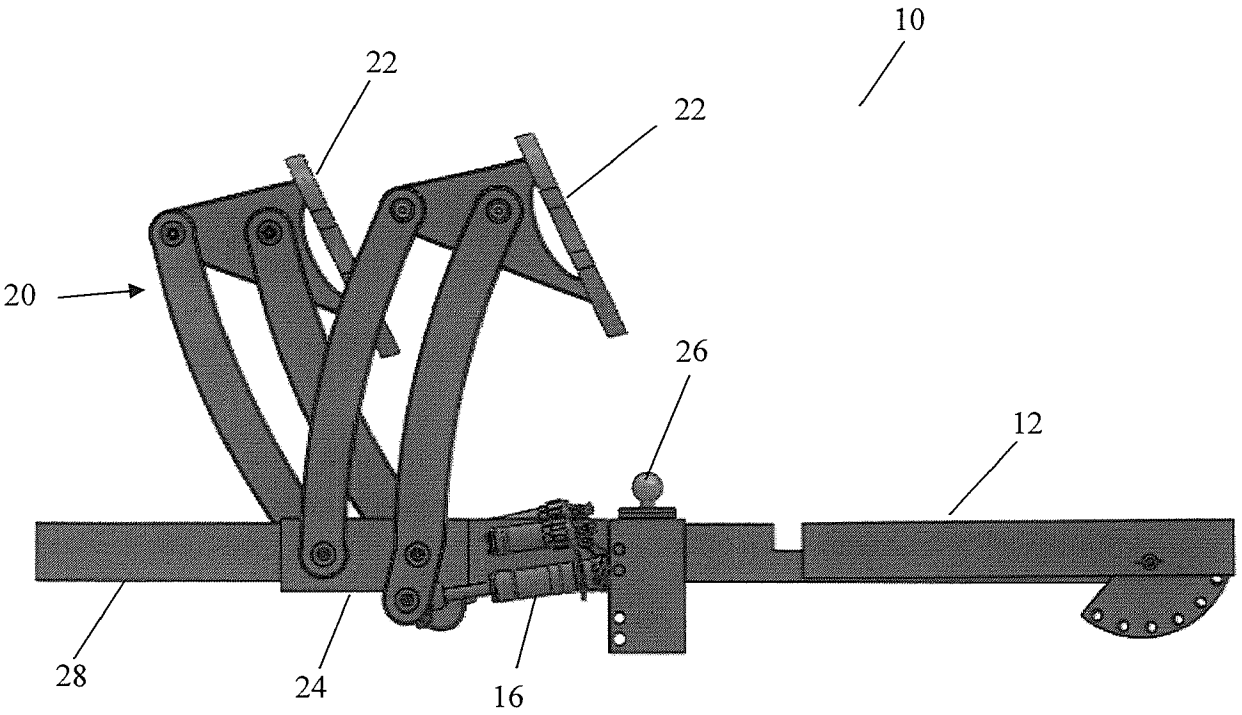
FIG. 5 illustrates a side elevation view of the leg press exercise apparatus including a spring-loaded knob and pin detent mechanism which allows the user to adjust the sliding member over a range of positions in an exemplary embodiment.

FIGS. 4-5 illustrate perspective and side elevation views, respectively, of the leg press exercise apparatus 10 in an exemplary embodiment. As shown in FIGS. 4-5, the sliding member 24 is easily adjusted over a range of positions (e.g., 14 cm in one embodiment) by a spring-loaded knob and pin detent system 26.

Figure 6:
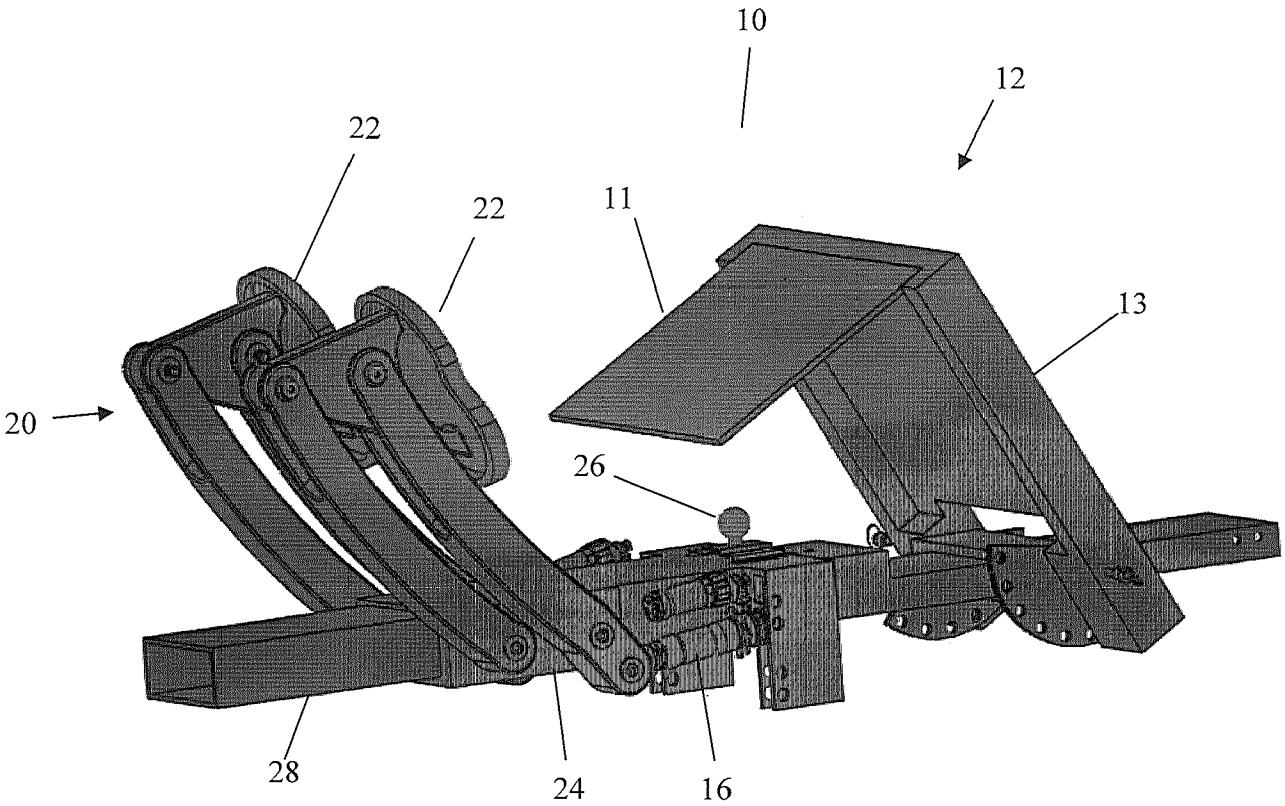
FIG. 6 illustrates a perspective view of the leg press exercise apparatus including a two-position chair in a raised position in an exemplary embodiment.
Figure 7:
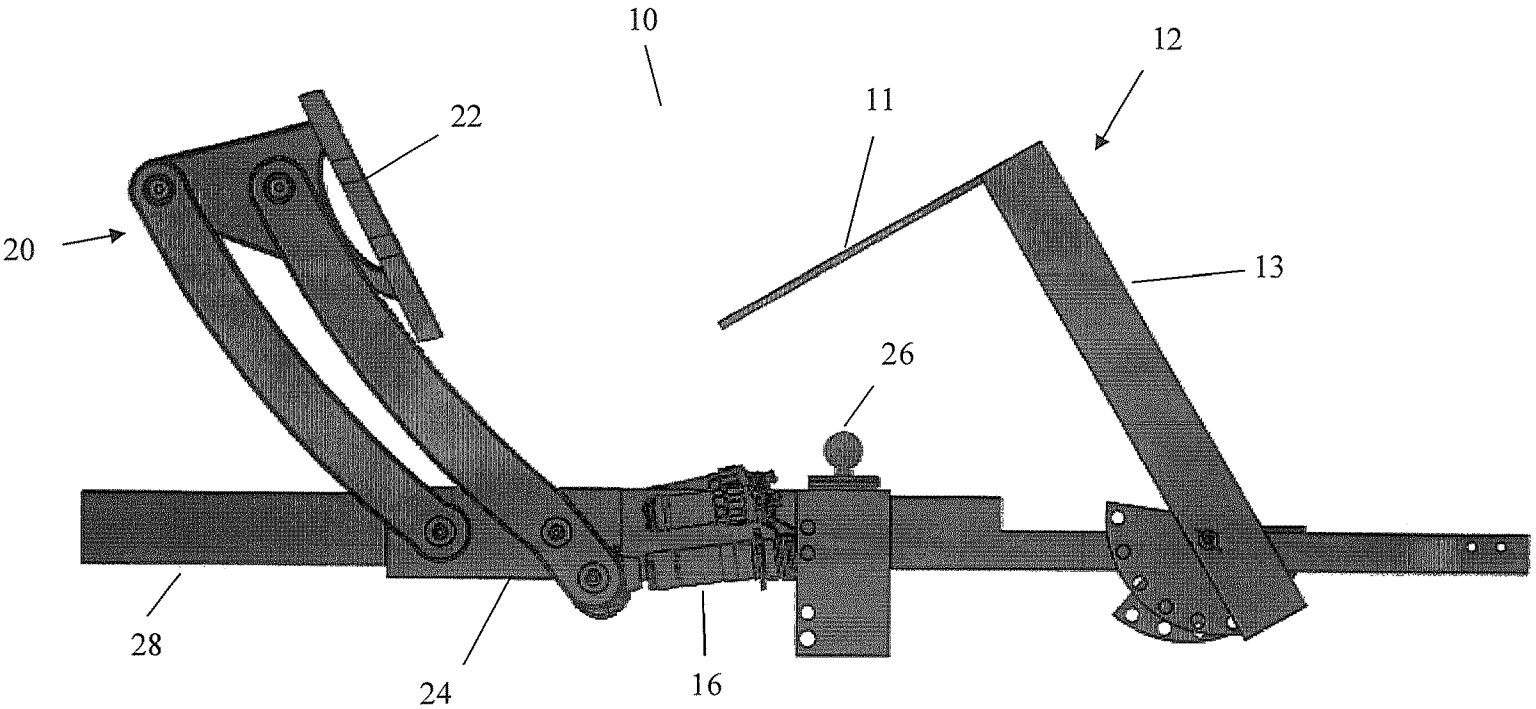
FIG. 7 illustrates a side elevation view of the leg press exercise apparatus including a two-position chair in a raised position in an exemplary embodiment.

FIGS. 6-7 illustrate a perspective and side elevation views, respectively, of the leg press exercise apparatus including a two-position chair in a raised position in an exemplary embodiment. The two-position chair 12 has frame members 11 and 13. Chair frame member 11 folds under the bottom side of frame chair member 13 to position the chair 12 for exercise. The raised position shown in FIGS. 5-6 enable the user to sit on frame member 11 until the user is ready to exercise.

2. Resistance

Figure 8:
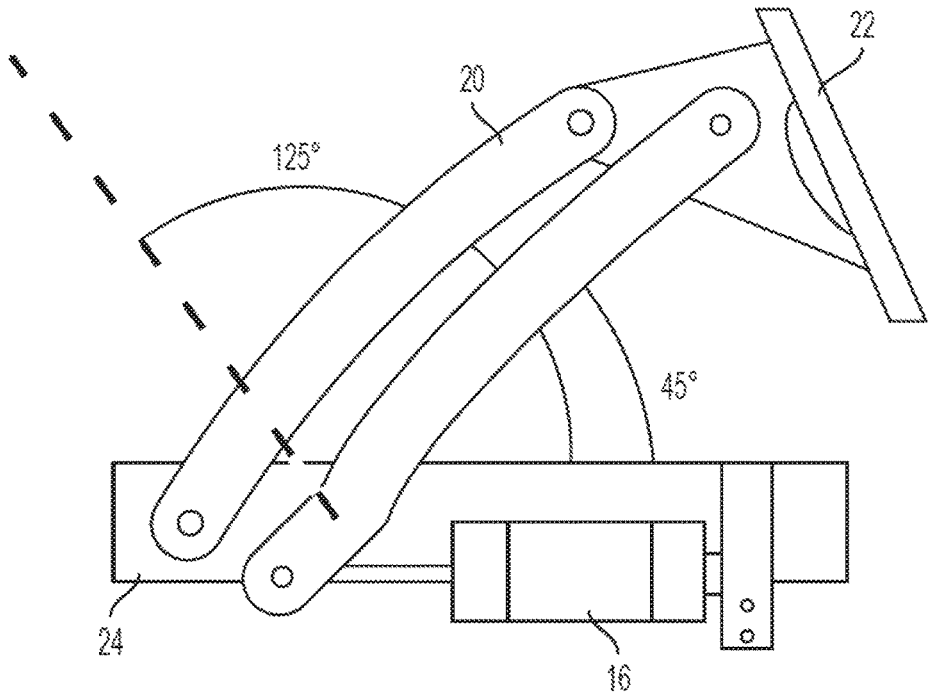
FIG. 8 illustrates the starting position of the leg press exercise apparatus with the spring at a resting position in an exemplary embodiment.
Figure 9:
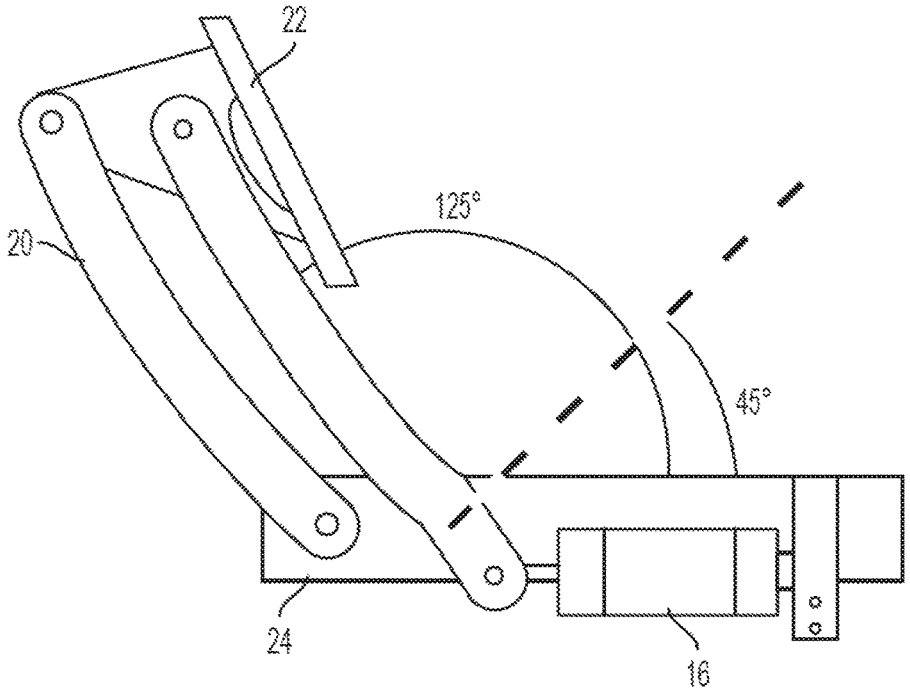
FIG. 9 illustrates the end position of the leg press exercise apparatus with the spring fully compressed in an exemplary embodiment.

The coil spring and damper system 16, acting as the prismatic joint in a slider-crank mechanism, provides the resistance for the leg press exercise apparatus 10. Using this force-generating slider-crank system in conjunction with the four-bar linkage 20 creates a nearly optimal resistance curve that approximates the strength curve of the user through the range of motion. This creates the high forces and stresses needed to maintain bone density and optimize the cardiovascular workout. FIG. 8 illustrates the starting position of the leg press apparatus 10 with the spring at a resting position. FIG. 9 illustrates the end position of the leg press exercise apparatus 10 with the spring fully compressed. The slider-crank mechanism compresses the linear spring, creating an increasing resistance throughout the movement and causing the largest load to be applied when the user's leg is fully extended. This trend in the resistance provides the desired optimized profile in relation to the human strength curve.

Figure 10:
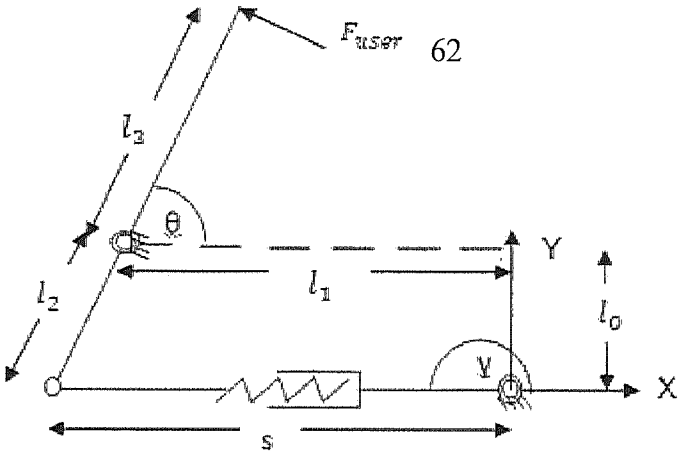
FIG. 10 illustrates a kinematic diagram of the leg press exercise apparatus in an exemplary embodiment.

The leg press exercise apparatus has been optimized to produce desirable force and motion properties using classical techniques in kinematics. FIG. 10 illustrates a kinematic diagram for an exemplary embodiment of the leg press mechanism. The loop closure equation (Eq. 1) and velocity loop equation (Eq. 2), described below, yield the position, s, and velocity, s-dot, of the slider crank mechanism given the input position, θ, and velocity, θ-dot. Static resistance is dependent only on the value of θ, which determines the compression of the spring and the geometry of the device.

Dynamic resistance depends on the user's motion profile (θ-dot). Assumed user motion profiles and their effect on dynamic resistance are discussed below. Once the position and velocity loop equations have been solved, virtual work can be used to find the resistive force, $F_{user}$, as a function of position, θ, from Eq. 3. The inertial term in Eq. 3, $I^*\ddot{\theta}\dot{\theta}$ is based on a position-dependent equivalent inertia approach known in the art. The motion of the user is expected to be slow, therefore, dynamic effects, including the force of the damper, are expected to be small. The damper is incorporated to prevent rapid movement in the event that the user's foot slips off the pedal. The damper also helps to discourage high-speed exercise motion.

$$l_0\hat{j}-l_1-l_2e^{j\theta}-se^{j\gamma}=0 \quad (1)$$

$$\hat{j}l_2\dot{\theta}e^{j\theta}-\dot{s}e^{j\gamma}-\hat{j}s\dot{\gamma}e^{j\gamma}=0 \quad (2)$$

$$I^*\ddot{\theta}\ddot{\theta}+F_{user}\dot{\theta}l_3+F_{spring}\dot{s}=0 \quad (3)$$

3. Resistance Due to Inertial Forces

The user must overcome the static spring forces, the damping forces, and the inertia forces generated by acceleration of the links of the exercise device. Inertia forces are incorporated in Eq. 3 by calculating an equivalent inertia of the system, I*, that varies with position. Eq. 4 shows how such an equivalent inertia is determined.

$$\frac{1}{2}I^* = \sum_{i=1}^{n}\frac{1}{2}m_i(\dot{x}_i^2+\dot{y}_i^2)+\frac{1}{2}I_i\dot{\theta}_i^2 \quad (4)$$

Eq. 4 takes into account the mass (m) and inertia (I) of every moving link in the mechanism. While all links contribute to the total user force, the mass of the foot pedal is of special concern. Because the foot pedal is at the extreme end of link $I_3$, it has the largest peak velocities and accelerations. The foot pedal is also the most massive element in the leg press exercise apparatus. One goal in designing the leg press exercise apparatus is to minimize inertial forces. This enables shaping the static resistance curve through kinematics to be as similar to the human strength curve as possible. Dynamic forces will change the shape of this curve as a function of how rapidly the user moves the foot pedal. Further analysis will show that the dynamic forces can be kept small.

In another embodiment, to further accommodate users of different strengths, an additional adjustment can be included in the leg press exercise apparatus. This additional feature personalizes the device by changing the initial preload in the spring along with the displacement curve. The geometry of the slider-crank mechanism can be changed by lowering the ground pivot on the right side of the mechanism as shown at 14 in FIGS. 1B, 1C, and 4-7 and schematically in FIG. 10. Lowering this pivot (i.e., changing the value of $l_0$) generally causes a vertical shift in the resistance curve.

During testing, the largest single-leg forces during resistance exercise were 1.16 BW (232 lbs) during supine position when γ, the angle between the horizontal and the ground pivot on the right side of the apparatus, equals 187 degrees and the minimal leg force was at 0.68 BW (136 lbs) when γ equals 177 degrees. The leg press exercise apparatus was able to elicit loads comparable to exercise on Earth since the forces were greater than 1 BW. When paired with LBNP, the maximum resistance load could be as low as 196 lbf when the LBNP is set for the recommended 50 mm Hg to achieve a maximum of 2 BW.

In a further embodiment, a linear actuator can be incorporated into the leg press exercise device to control the position of the ground pivot. The adjustment will occur automatically based on the user's heart rate (HR). The user will be required to keep a steady target heart rate that will be determined, using Eq. 5, before testing and monitored throughout the workout. The spring can be changed manually with the use of quick release pins.

$$HR_{target}=((HR_{max}-HR_{rest})*\%_{intensity})+HR_{rest} \quad (5)$$

4. Biomechanics

Ground reaction forces (GRF) are created by static and dynamic loading. The forces experienced in 1G are due to the user's weight (static) and the dynamic loading is due to movement. To simulate forces equivalent to those experienced in 1G, the ground reaction force must be equal to or greater than 1 BW. As indicated in Eq. 6, the GRF are directly related to the pressure differential force and the total user force applied to move the foot pedal. It should be noted that the vacuum feature of the LBNP box was not used during preliminary testing.

$$\text{GRF}=(\text{Pressure Differential Force})+(\text{Total User Force}) \quad (6)$$

Eq. 6 states that the pressure differential force (the product of the body cross-sectional area multiplied by the pressure differential across the LBNP Box, which will be assumed to equal 50 mm Hg) plus the total user force (the inertial forces caused by geometry and the force required to overcome the resistance of the coil spring and damper system) equals the ground reaction force. The total user's force includes the inertial forces caused by the leg press exercise apparatus and the force required to overcome the resistance of the coil spring and damper system.

Two Member Chair Serves as Daily Activity

The posterior side of the lower extremities are accustomed to ⅔ BW between six and eight hours a day. The chair simulates this daily activity of sitting by translating a fixed linear force to the active areas. The force applied is simulated from the negative pressure in the LBNP Box.

As indicated in Eq. 7, if the user is sitting or remains static, the total user force term in Eq. 6 equals zero. The GRF then becomes:

$$\text{GRF}=\text{Pressure Differential Force}=Axy*\Delta P \quad (7)$$

The chair is adjustable in both angle and linear distance by the use of quick release pins and a sliding member. The chair can be folded easily and has a resting position horizontal to the center bar. The chair can be cushioned by foam and covered with leather allowing the user to both exercise and sit comfortably.

Integration of Leg Press Exercise Apparatus with LBNP Box

The leg press exercise apparatus can be manufactured to be removable, without disassembly, from the LBNP inner structure. The leg press exercise apparatus can be attached to a trolley system, making the apparatus maneuverable and easily accessible which allows the user to adjust his personal settings outside of the LBNP Box. The parallel arms and seat collapse horizontally to the center bar allowing the removal process to be quick, easy, and safe.

Integration of the Leg Press Exercise Apparatus and the Upright Device

Figure 11:
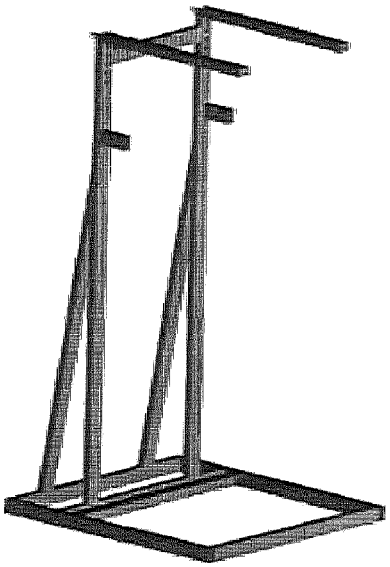
FIG. 11 illustrates perspective view of an upright device to support the leg press exercise apparatus in a vertical position in an exemplary embodiment.

FIG. 11 illustrates a perspective view of an upright device for supporting the leg press exercise apparatus in a vertical position.

The physiological and biomechanical responses of each user can be recorded in both the supine and upright position in order to collect comparative data. In the upright position, there will be no added negative pressure or suction force, only the effects of gravity. Data collected in the upright position can be compared to similar data in the supine position. If the LBNP is effective, user forces, heart rate, and expended energy should be comparable between the two configurations.

Resistance Profile

It is well known that the human body is a highly nonlinear mechanical device from the standpoint of generating forces over a given cycle of motion. The leg press provides a good example of this. A plot of the maximum force a user can produce at each point in the outward cycle of a leg press would show, not surprisingly, that the user is able to generate far more force at the extreme position (when the knee joint is at full extension) than when the knee is sharply bent. Mechanical work and physiology stress in the muscles will be nearly optimized when the resistance provided by a leg press exercise machine most nearly matches this strength curve. Stated simply, the resistance curve should match the human strength curve for optimal efficiency in strengthening muscle and stressing bone. Although the strength curve varies from user to user as does the resistance curve, the general shape of the curves is approximately maintained. The leg press exercise apparatus approximately matches the resistance provided by the apparatus with the human strength curve in a leg press exercise. An adjustment could be provided to raise and lower the magnitude of resistance while keeping the general shape of the curve. The slider-crank mechanism used in the leg press exercise apparatus creates an excellent approximation to the human strength curve when considering only the resistance of the spring. By limiting dynamic forces, the overall apparatus exhibits an excellent resistance curve under typical operating conditions.

Figure 12:
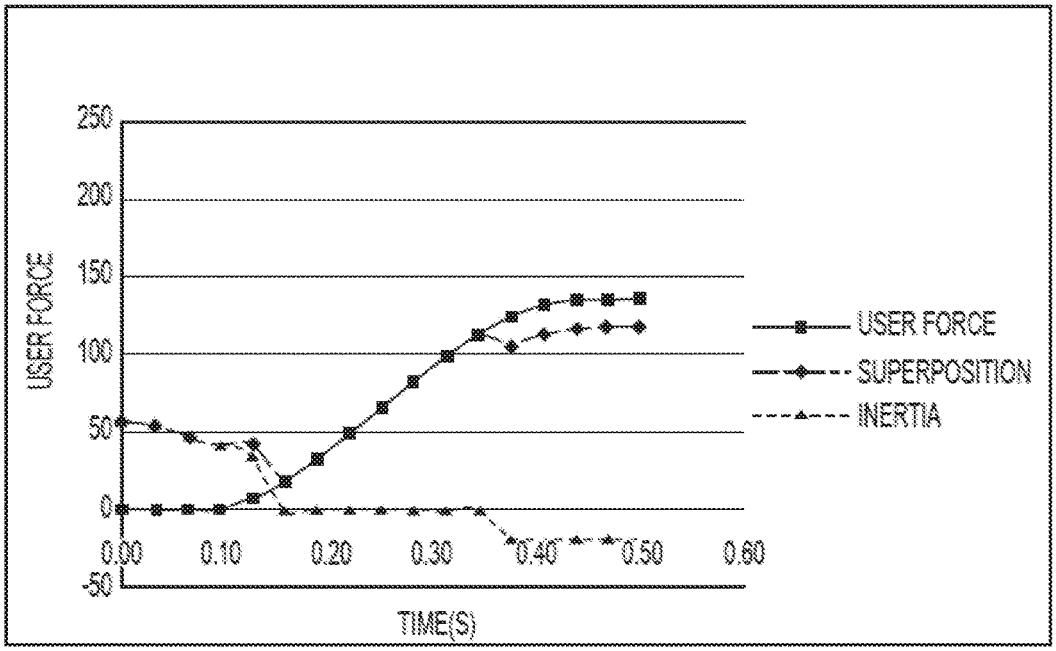
FIG. 12 illustrates a resistance profile for the LBNP leg press apparatus assuming a positive and negative constant angular acceleration of the foot pedal separated by a period of constant velocity.
Figure 13:
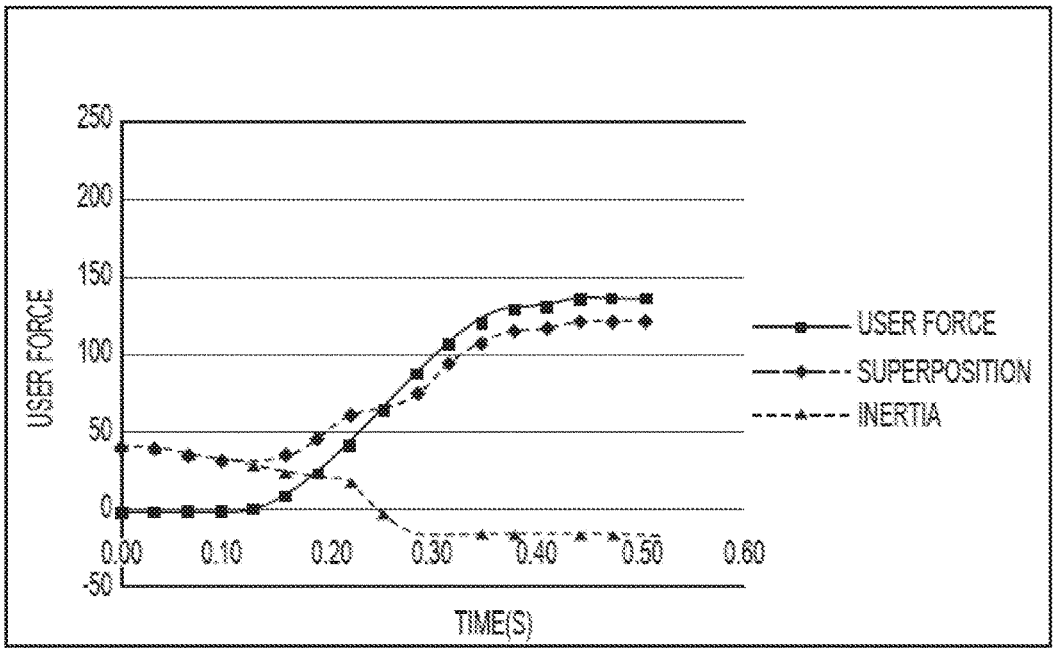
FIG. 13 illustrates a resistance profile for the LBNP leg press apparatus assuming a positive and negative constant angular acceleration of the foot pedal and not having a period of constant velocity.

The theoretical resistance provided by the leg press exercise apparatus can be calculated under a set of assumed conditions. The analysis uses the actual link masses and inertias from the apparatus. The most important assumption necessary to perform a complete analysis is the user's motion profile. Since the foot petals reciprocate, their angular velocity will be zero at the beginning and end of each stroke. Velocity should ramp up to a peak somewhere between these endpoints, but there is no way to precisely predict how the user will accelerate and decelerate. Results from testing indicate that a typical user moves at about one cycle of motion per second. Two different motion profiles were used to calculate the inertia and user force. The first profile used constant angular acceleration of the foot pedal link to start and end the motion cycle and a period of constant velocity in between. The second motion profile was similar, but had no period of constant velocity motion separating the periods of positive and negative constant acceleration. The results of these two analyses are shown in FIG. 12 and FIG. 13, respectively. In both figures, the user force curve shows the user force on the foot pedal due to the resistance of the spring, the inertia curve shows the user force on the pedal due to dynamic effects, and the superposition curve is the net user force on the pedal through a 0.5 second stroke.

Figure 14:
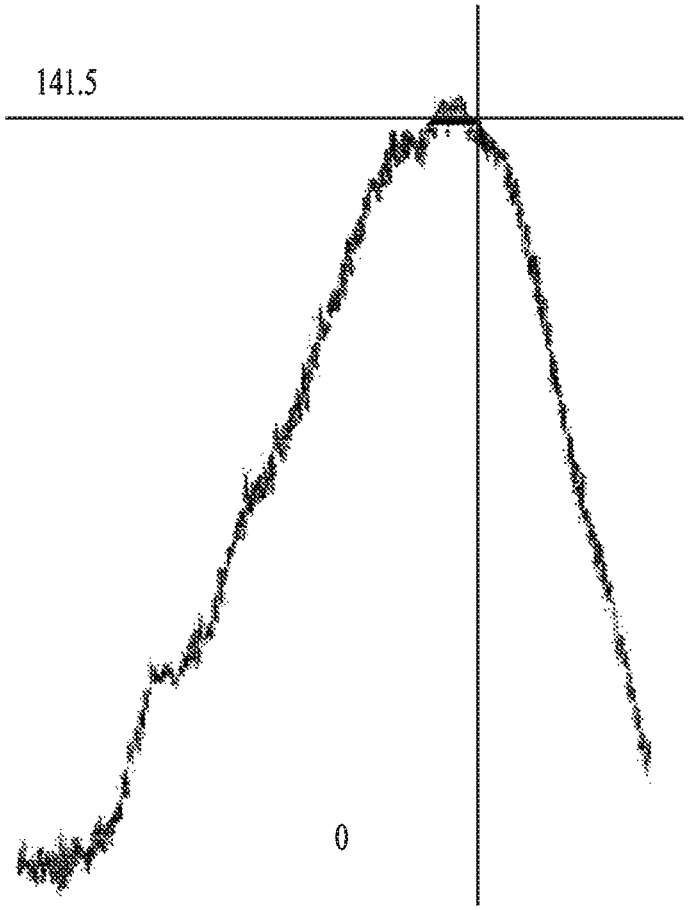
FIG. 14 illustrates results from an electrogoniometer test with the user in the supine position.

In one test of the multi-user device, an electrogoniometer was applied to the subject's left knee, centered directly over the rotational joint. FIG. 14 illustrates the results from the electrogoniometer test when the use is in the supine position. The electrogoniometer limits were calibrated for 0° when the user's knee was straight, the top limit equaled 200 volts, and for 90°, when the user's knee was bent, the lower limit equaled zero volts. The vertical line in FIG. 14 indicates a maximum voltage of 141.5 volts at roughly 90 degrees. This curve indicates that the user is generally accelerating or decelerating the foot pedal, with little or no constant velocity in the middle.

Figure 15:
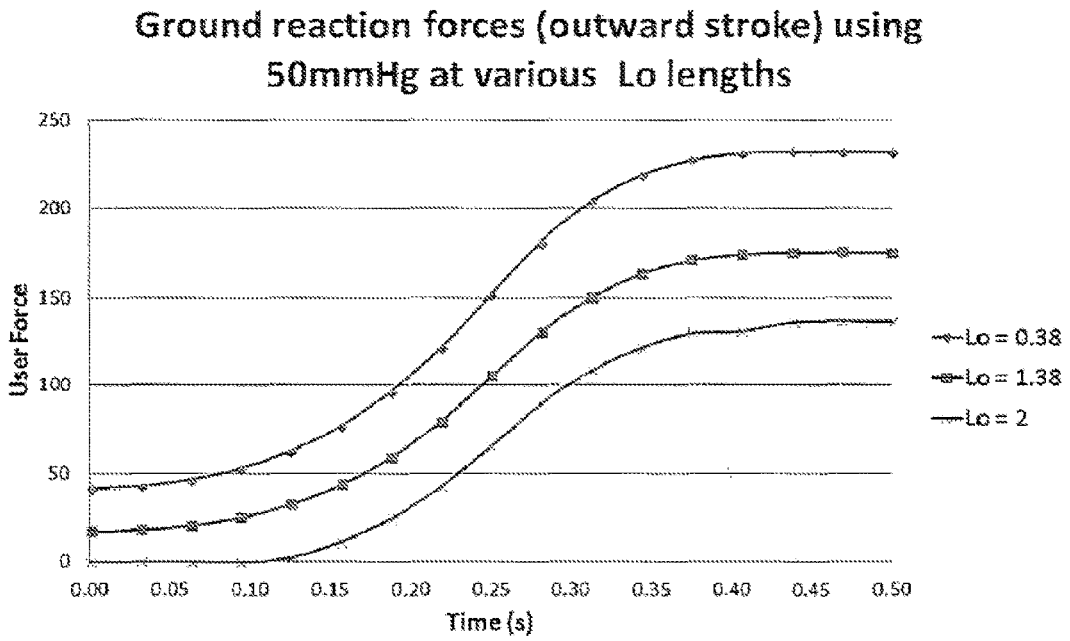
FIG. 15 illustrates variations in the user's force as the spring preload increases through a change in dimension $I_0$.

The analysis also considered the effect of varying the spring preload and the effect of the LBNP Box pressure difference on the foot pedal forces exerted by the user. The graphs in FIG. 15 show the variation in user foot pedal force as the spring preload increases through a change in the adjustable dimension $l_0$. The top curve used a dimension $l_0$=0.38. The middle curve used a dimension $l_0$=1.38. The bottom curve used a dimension $l_0$=2.0.

Exercising in space is the most effective known method of counteracting the deleterious effects of living for prolonged periods in low gravity conditions. However, even with rigorous exercise, astronauts typically lose 0.4-1.0% of their bone density per month in space. Although astronauts gradually recover their muscle tissue and most of their bone mass when they return to Earth, it is important that they are strong enough to perform emergency procedures during landing. Coupling appropriate resistance exercise with a Lower Body Negative Pressure (LBNP) Box will improve on the current state of the art in preventing deconditioning and bone loss.

The leg press exercise apparatus was designed to fit within an existing LBNP Box, which placed significant constraints on its dimensions and operation. This caused the length requirement for the subject's lower extremities, waist to sole of foot, to range from 70 cm to 82 cm. A linear actuator in another embodiment would change the level of resistance based directly off the subject's heart rate.

After testing the embodiment illustrated in FIGS. 4-5, it was found that the angle of the foot pedal is preferably adjusted so that the user's foot maintains an angle closer to 90° throughout the entire cycle rather than just toward the beginning and the end of the stroke. If too much of the force from the subject's foot is directed along the link, user forces will be somewhat higher than desired for the first half of the pedal stroke.

Overall, the combination of the multi-platform and the LBNP Box provides the advantage of minimizing deconditioning in a safe, compact, lightweight and efficient way for space travelers to exercise. The leg press exercise apparatus can also incorporate automated adjustments and feedback control to maintain the user's heart rate while providing near optimal resistance curves.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. An exercise apparatus for use with a lower body negative pressure box, comprising:

a rectangular base frame having a longitudinal axis;

an adjustable sliding frame member having opposing first and second sides and mounted on the frame, wherein a position of the sliding frame member is adjustable along the longitudinal axis of the base frame to accommodate users of different heights;

a pair of four-bar linkage assemblies each comprising a pair of spaced apart, parallel bars, the pair of assemblies being disposed laterally spaced from each other symmetrically about the longitudinal axis of the base frame and actuable in parallel planes, the parallel planes being parallel to each other and to the longitudinal axis, wherein each of the parallel bars has a first end and a second end, and wherein said second end of both bars in each pair of assemblies is attached at respective first pivot points to the adjustable sliding frame member, the adjustable sliding frame member thereby forming between these respective pivot points a ground link for each of the four-bar linkage assemblies, and wherein said first end of both bars of each pair of linkage assemblies is attached to a respective support bracket at respective bracket pivot points, each of said support brackets between these bracket pivot points forming a respective fourth link in each of the four-bar linkage assemblies, and wherein each of the pair of bars form, between a respective first pivot point and a respective bracket pivot point, a first or second link in each of the four-bar linkage assemblies;

a first foot pedal mounted on a first support bracket;

a second foot pedal mounted on a second support bracket;

a pair of spring and damper assemblies respectively attached at a first end to a respective first ground pivot on the adjustable sliding frame member, and at a second end to one respective bar of the pair of bars at a spring-and-damper pivot point spaced from a first and second bracket pivot point;

a spring-loaded pin detent mechanism for adjusting the position of the sliding frame member to accommodate each user; and a chair adjustable in both angle and linear distance to apply a resistance force to a posterior side of the user's lower extremities during use of the exercise apparatus, wherein the spring and damper assemblies are configured to provide a spring force tending to resist movement of the four-bar linkage away from the chair;

wherein the position of the respective ground pivots between each of the spring and damper assemblies and the adjustable sliding frame member are adjustable, thereby providing adjustable spring resistance;

the exercise apparatus further comprising a linear actuator to automatically control the position of at least one of the ground pivots based on the user's heart rate.

2. The exercise apparatus of claim 1, wherein each of the four-bar linkage assemblies has a parallelogram configuration such that each said foot pedal traverses a circular-arc path at a substantially fixed angle relative to the frame and thereby maintains a substantially perpendicular relationship between a lower leg and foot of a user during exercise.

3. The exercise apparatus of claim 1, wherein the chair is a two member chair.

4. The exercise apparatus of claim 1, wherein the foot pedals are configured to maintain an approximately perpendicular angle with respect to respective lower legs of a user, thereby optimizing usage for retention of bone density of a user.

5. An exercise apparatus for use with a lower body negative pressure box, comprising:

a rectangular base frame having a longitudinal axis;

an adjustable sliding frame member having opposing first and second sides and mounted on the frame, wherein a position of the sliding frame member is adjustable along the longitudinal axis of the base frame to accommodate users of different heights;

a pair of four-bar linkage assemblies each comprising a pair of spaced apart, parallel bars, the pair of assemblies being disposed laterally spaced from each other symmetrically about the longitudinal axis of the base frame and actuable in parallel planes, the parallel planes being parallel to each other and to the longitudinal axis, wherein each of the parallel bars has a first end and a second end, and wherein said second end of both bars in each pair of assemblies is attached at respective first pivot points to the adjustable sliding frame member, the adjustable sliding frame member thereby forming between these respective pivot points a ground link for each of the four-bar linkage assemblies, and wherein said first end of both bars of each pair of linkage assemblies is attached to a respective support bracket at respective bracket pivot points, each of said support brackets between these bracket pivot points forming a respective fourth link in each of the four-bar linkage assemblies, and wherein each of the pair of bars form, between a respective first pivot point and a respective bracket pivot point, a first or second links in each of the four-bar linkage assemblies;

a first foot pedal mounted on a first support bracket;

a second foot pedal mounted on a second support bracket;

a pair of spring and damper assemblies respectively attached at a first end to a respective first ground pivot on the adjustable sliding frame member, and at a second end to one respective bar of the pair of bars at a spring-and-damper pivot point spaced from a first and second bracket pivot point, thereby providing a resistive force to movement of the four-bar linkage;

a spring-loaded pin detent mechanism for adjusting the position of the sliding frame member to accommodate each user; and a chair adjustable in both angle and linear distance to apply a resistance force to a posterior side of the user's lower extremities during use of the exercise apparatus, wherein the position of the respective ground pivots between each of the spring and damper assemblies and the adjustable sliding frame member are adjustable, thereby providing adjustable spring resistance;

the exercise apparatus further comprising a linear actuator to automatically control the position of at least one of the ground pivots based on the user's heart rate.

6. The exercise apparatus of claim 5, wherein the foot peals are configured to maintain an approximately perpendicular angle with respect to respective lower legs of a user, thereby optimizing usage for retention of bone density of a user.

7. The exercise apparatus of claim 5, wherein the chair is a two member chair.

8. An exercise apparatus for use with a lower body negative pressure box, comprising:

a rectangular base frame having a longitudinal axis;

an adjustable sliding frame member having opposing first and second sides and mounted on the frame, wherein a position of the sliding frame member is adjustable along the longitudinal axis of the base frame to accommodate users of different heights;

a pair of four-bar linkage assemblies each comprising a pair of spaced apart, parallel bars, the pair of assemblies being disposed laterally spaced from each other symmetrically about the longitudinal axis of the base frame and actuable in parallel planes, the parallel planes being parallel to each other and to the longitudinal axis, wherein each of the parallel bars has a first end and a second end, and wherein said second end of both bars in each pair of assemblies is attached at respective first pivot points to the adjustable sliding frame member, the adjustable sliding frame member thereby forming between these respective pivot points a ground link for each of the four-bar linkage assemblies, and wherein said first end of both bars of each pair of linkage assemblies is attached to a respective support bracket at respective bracket pivot points, each of said support brackets between these bracket pivot points forming a respective fourth link in each of the four-bar linkage assemblies, and wherein each of the pair of bars form, between a respective first pivot point and a respective bracket pivot point, a first or second links in each of the four-bar linkage assemblies;

a first foot pedal mounted on a first support bracket;

a second foot pedal mounted on a second support bracket;

a pair of spring and damper assemblies respectively attached at a first end to an adjustable respective first ground pivot on the adjustable sliding frame member, and at a second end to one respective bar of the pair of bars at a spring-and-damper pivot point spaced from a first and second bracket pivot point, thereby providing a resistive force to movement of the four-bar linkage;

a spring-loaded pin detent mechanism for adjusting the position of the sliding frame member to accommodate each user; and a chair configured to apply a resistance force to a posterior side of the user's lower extremities during use of the exercise apparatus in microgravity that mimics sitting forces experienced by a user in normal gravity;

wherein the position of the respective ground pivots between each of the spring and damper assemblies and the adjustable sliding frame member are adjustable, thereby providing adjustable spring resistance;

the exercise apparatus further comprising a linear actuator to automatically control the position of at least one of the ground pivots based on the user's heart rate.

9. The exercise apparatus of claim 8, wherein the chair is a two member chair.

10. The exercise apparatus of claim 8, wherein the foot pedals configured to maintain an approximately perpendicular angle with respect to respective lower legs of a user, thereby optimizing usage for retention of bone density of a user.

11. The exercise apparatus of claim 8, wherein the foot pedals are adjustable.

12. The exercise apparatus of claim 1, wherein the foot pedals are adjustable.

* * * * *